US005383748A

United States Patent [19]

Waddell

[11] Patent Number: 5,383,748

[45] Date of Patent: Jan. 24, 1995

[54] OFFSHORE STRUCTURE AND INSTALLATION METHOD

[75] Inventor: John W. Waddell, Orpington, England

[73] Assignee: Kvaerner Earl and Wright (a division of Kvaerner H&G Offshore Ltd.), United Kingdom

[21] Appl. No.: 109,464

[22] Filed: Aug. 20, 1993

Related U.S. Application Data

[63] Continuation of Ser. No. 901,144, Jun. 19, 1992, abandoned.

[30] Foreign Application Priority Data

Jun. 19, 1991 [GB] United Kingdom ..... 9113194

[51] Int. Cl.[6] ..... E02B 17/02

[52] U.S. Cl. ..... 405/217; 405/224

[58] Field of Search ..... 405/195.1, 203, 204, 405/211, 217, 224, 227, 228

[56] References Cited

U.S. PATENT DOCUMENTS

| | | | |
|---|---|---|---|
| 3,751,930 | 8/1973 | Mott et al. | 61/46.5 |
| 4,456,072 | 6/1984 | Bishop | 405/217 X |
| 4,470,725 | 9/1984 | Kure et al. | 405/212 |
| 4,504,172 | 3/1985 | Clinton et al. | 405/217 |
| 4,537,532 | 8/1985 | Chen et al. | 405/217 |
| 4,618,286 | 10/1986 | Michel et al. | 405/217 X |
| 4,655,642 | 4/1987 | Birdy et al. | 405/217 |
| 4,666,343 | 5/1987 | Butt et al. | 405/217 |

FOREIGN PATENT DOCUMENTS 2017793 1/1979 United Kingdom .
2017794 1/1979 United Kingdom .
2218447 11/1989 United Kingdom .

OTHER PUBLICATIONS

OTC 7053 "Hybrid Piled/Gravity Platform for Harsh Environments" by J. W. Waddell, Kvaerner Earl & Wright, and Fred Pearce and Harold Stibbs, BHP Petroleum-printed from the 24th Annual OTC in Houston, Tex., May 4–7, 1992.

Visser, *A Retrospective of Platform Development in Cook Inlet, Ak.*, OTC 5929, pp. 467–479 (1989).

Comyn, *Operational Experience With an Arctic Structure: The Caisson Retainer Island,* OTC 4945, pp. 417–424 (1985).

Bea, *Piling Aids Gravity in Ice Resistance,* Offshore, Aug., 1984, pp. 99–100.

Oil & Gas Journal 67, Dec. 26, 1983, *1984 See as Key Year in Canadian Beaufort Sea.*

*Primary Examiner*—David H. Corbin
*Attorney, Agent, or Firm*—Bacon & Thomas

[57] ABSTRACT

The invention provides an improved structure for standing offshore, particularly in arctic environments, and a method for installing this structure. The structure comprises a shield portion which rests on a seabed and primarily resists environmental loads, such as from ice, and a separate support portion which comprises a plurality of piles driven into the seabed to support a deck payload. The method for installing the structure comprises moving a shield portion of the structure to its intended location with piles pre-installed therein, setting the structure on the seabed, driving the piles into the seabed, and then severing any connection between the piles and the shield portion.

4 Claims, 4 Drawing Sheets

OFFSHORE STRUCTURE AND INSTALLATION METHOD

This application is a continuation of application Ser. No. 07/901,144, filed Jun. 19, 1992, now abandoned.

The invention relates to an offshore structure, and to a method of installing such a structure.

In particular, the invention relates to an offshore structure that is supported on a seabed both by piles and by direct bearing. The structure is hereinafter described as a hybrid piled/gravity structure. The structure is designed to resist severe environmental conditions including sea ice and earthquake loads.

At the present time the only major application of offshore structures for oil or gas production in an ice environment is in the Cook Inlet, Ak. where around fifteen conventionally piled structures are in place. Experience with these structures is discussed in OTC Paper 5929 presented at the 21st OTC at Houston, Tex. in 1989. However, in Cook Inlet, the ice environment is relatively benign, with sheet ice thickness in the region of 1.5 m being the design case. Conventionally piled structures have proved adequate for these conditions. The hybrid piled/gravity structure of the present invention is designed for much more severe ice conditions.

Conventional gravity platforms have been proposed for use off the North Slope of Alaska and for the Beaufort Sea. Gravity platforms are commonly sited on strong seabed soils, although occasionally they are sited on weak soils. These platforms are supported by direct bearing on the seabed. In the case of weak soils, supplementary support can be provided by peripheral walls or skirts that project downwards from the base slab at the seabed, penetrating the soils and effectively acting as piles. An example of this type of platform is described in the publication 'Offshore' for August 1984 pp 99 and 100.

Artificial islands have also been constructed in Arctic waters to exploit offshore hydrocarbon resources. These are inherently ice resistant, but are generally only suitable for water depths of less than 15–20 meters. Sometimes these islands may be surmounted by a caisson that sits on a raised seabed (berm) and projects above water. An example of such an island is described in OTC Paper 4945 presented at the 17th OTC at Houston, Tex. in 1985. The caisson, which is backfilled with soils, is an alternative means of creating the upper part of the island. This method of construction has certain advantages, but the application is still limited to water depths of the order of 20–25 meters, particularly where the severity of the weather limits opportunities for island construction.

Other ice environment developments include mobile substructures, which are primarily designed only for drilling for oil or gas. These can be moved in the event of extreme ice loadings. One such unit is shown in the publication 'Oil and Gas Journal' Dec. 26th 1983, p67.

None of the development options outlined above—piled structures, gravity platforms, artificial islands or mobile substructures—provide attractive development options for permanent drilling and production facilities in water depths over 25 m where drifting ice and seismic loads may be encountered.

The invention provides a structure to stand offshore, e.g. in an ice infested environment, which structure has a shield portion which rests on a seabed and primarily resists environmental loads, and a separate support portion which comprises a plurality of piles driven into the seabed to support a deck pay load.

It is preferred that the shield portion is a conical or cylindrical tower with a relatively small projected area at the water line.

In one form it is preferred that the piles are preinstalled in the shield portion of the structure.

In this form it is further preferred that there is provision for a pile driving hammer to be supported temporarily on the structure for driving the preinstalled piles into the seabed.

The shield portion may be of doubled skin construction, in which case at least a part of the space between the skins may be filled with grout after installation.

It is additionally preferred that there is a permanent deck installed on top of the plurality of piles.

The invention also provides a method of installing a structure having a shield portion which rests on a seabed and primarily resists environmental loads, and a separate support portion which comprises a plurality of piles driven into the seabed to support a deck pay load; which includes the steps of moving the shield portion of the structure to its intended location with piles preinstalled therein, setting the structure on the seabed, driving the piles into the seabed, and then severing any connection between the piles and the shield portion.

A specific embodiment of the invention will now be described by way of example with reference to the accompanying drawings in which.

Figure 1:
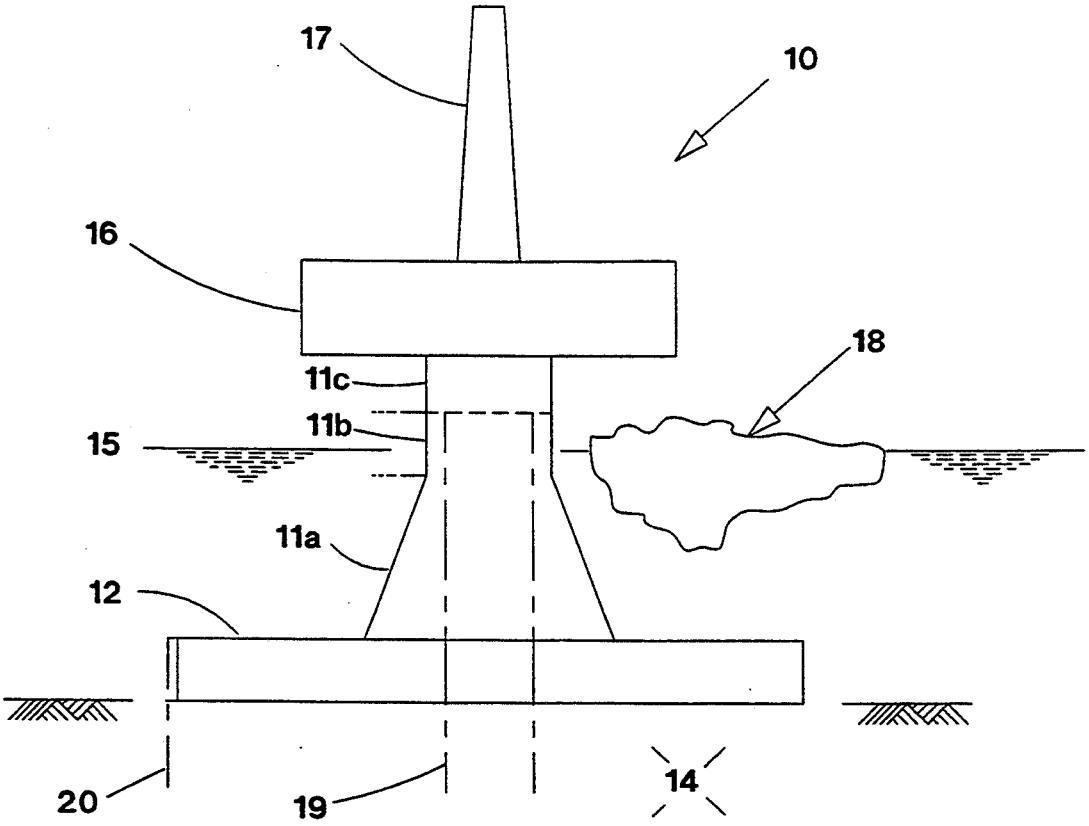
FIG. 1 is a diagrammatic side elevation of a hybrid piled/gravity structure.

As shown in FIG. 1, a hybrid piled/gravity structure 10 has a leg 11 and a base 12. The base 12 is founded on a seabed 14, and the leg 11 projects upwards through a sea surface 15. The leg has a lower frustro conical portion 11*a*, and an upper cylindrical portion 11*b*. It is the cylindrical portion 11*b* which projects through the sea surface. There is a further leg portion 11*c* attached to the underside of a deck 16. The deck 16 may be surmounted by a drilling rig 17 positioned over the leg 11.

The hybrid piled/gravity structure 10 is designed to stand in waters subject to drifting ice, and an ice flow is illustrated at 18. The outer surfaces of the leg portions 11*a* and 11*b* form a shield against drifting ice.

Figure 2:
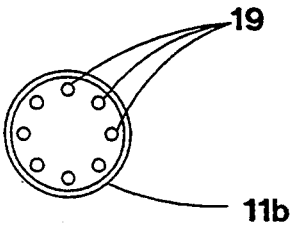
FIG. 2 is a cross-section through a leg of that structure.

The leg 11 is hollow, and deck support piles 19 are located within the leg. As shown in FIG. 2, these deck support piles are structurally independent of the leg portions 11*a* and 11*b* and base 12.

The specific embodiment of the present invention shown in FIGS. 1 and 2 has the geometric characteristics of a typical monopod gravity platform, namely large plan dimensions (for base 12) that are sized for optimum on-bottom pressures to suit the supporting soil. A further feature of the structure is its floating stability in a pre-installed condition enabling the structure to be completed in a dock, floated to the location of the intended offshore development and ballasted directly onto the seabed with minimum offshore activity.

This is an important characteristic for an offshore development at a remote location.

The lower part of the structure, comprising the base 12 and leg portions 11*a* and 11*b*, can be built in concrete or steel, or a combination of the two materials.

A concrete structure provides inherent self-weight which will enhance resistance to sliding on sand foundations and will reduce the requirement for fill material to balance overturning forces. (The robust properties of concrete can, as an alternative, be provided by a double-skinned steel construction post-grouted after float-out).

A steel structure is suitable for weaker seabed soils since its mass is less than that of a concrete structure of similar dimensions. A structure with lower mass is also likely to be more structurally efficient under earthquake loading. A steel structure will have a shallower floatation draft and may allow simpler construction. For instance, a steel structure can be built in a dry dock and floated out from a fabrication site adjacent to shallower water than would be possible with a concrete structure.

The choice of steel or concrete will depend upon construction economics, including the availability of local fill material at the offshore location.

Significantly, the present invention uses deck support piles 19 within the leg 11 and well away from the outer periphery of the structure (FIG. 1). These piles 19 are designed to support the deck 16 and topsides (e.g. for drilling and production facilities). When installed and in an operating configuration, there is no primary structural connection between the piles 19 and the base 12 and leg portions 11*a* and 11*b* (FIG. 2). In such a case the leg portions 11*a* and 11*b* act as a shield in a purely protective manner, resisting the ice environment without transferring load to the deck support piles 19. In any event the leg 11 projecting through the ice zone would be heavily stiffened, possibly comprising a grouted doubled-skin construction to resist high local loads from ice impacts.

The specific embodiment of the present invention may have peripheral skirts 20 for applications on weak soils, or to carry a proportion of lateral loads. Peripheral piles are an alternative to skirts if support is required from deep soil strata. These peripheral skirts 20 (or piles) are primarily present to resist environmental loads, and have a fundamentally different purpose from the deck support piles 19.

An outline description will now be given of how the hybrid piled/gravity structure is constructed and installed.

The base 12 and leg portions 11*a* and 11*b* can be constructed in a floodable dock (FIG. 3) from steel or concrete or a combination of the two materials. The shield portion may be of doubled skin construction.

Figure 4:
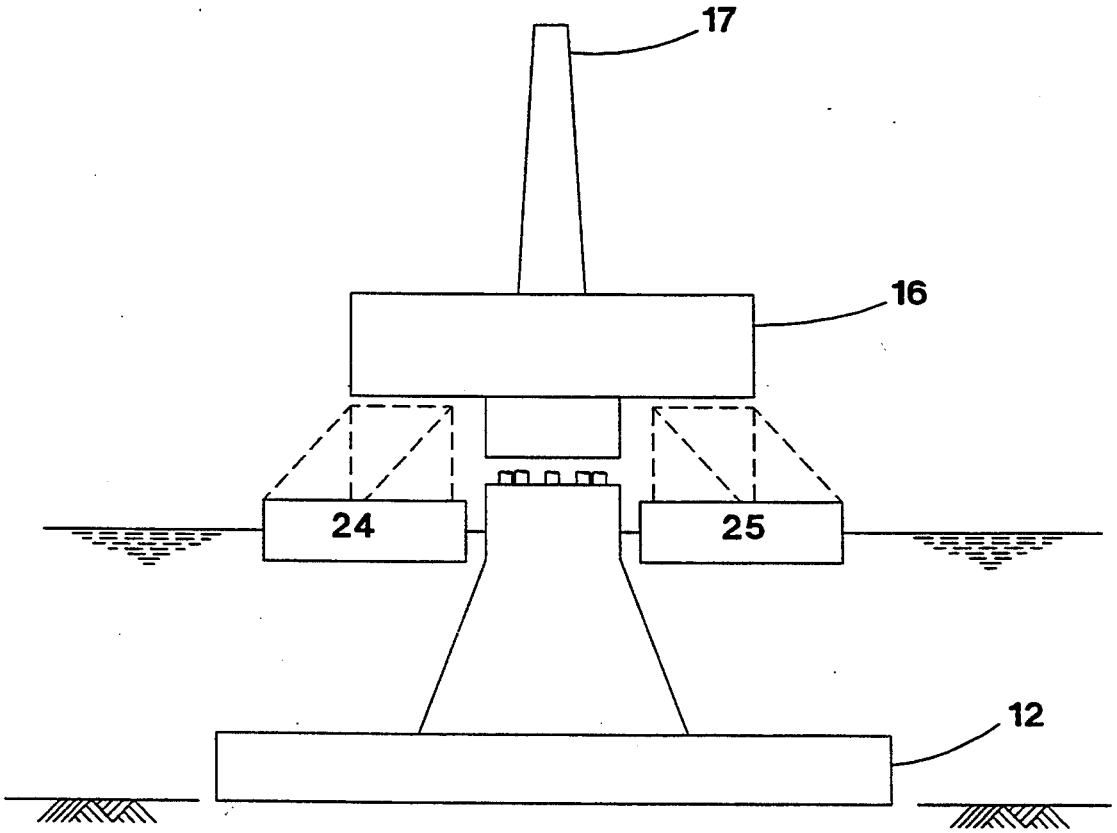
Figure 5:
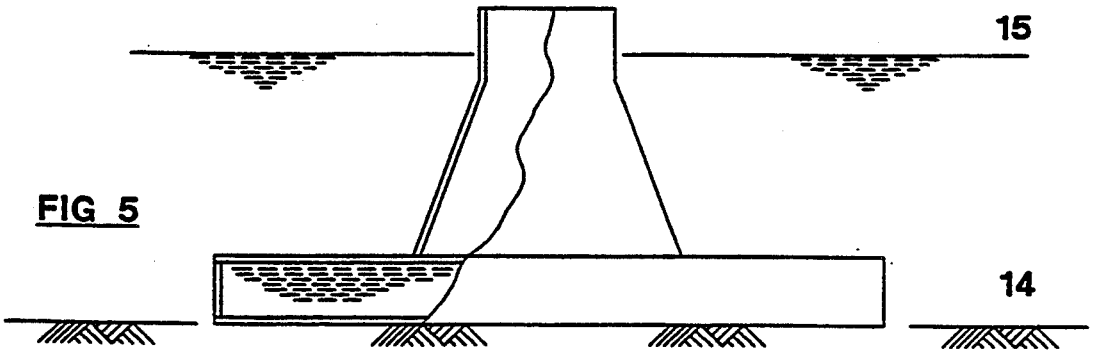
Figure 6:
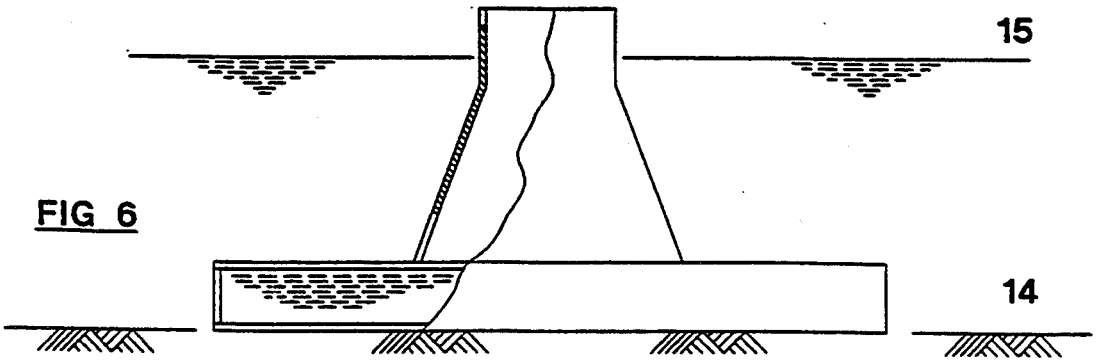

The base 12 and leg portions 11*a* and 11*b* can then be towed to the location of the intended offshore oil/gas development (FIG. 4), where they are lowered (by ballasting) to rest on the seabed 14 (FIG. 5). The shield portion may be of doubled skin construction, in which case at least a part of the space between the skins may be filled with grout after installation (FIG. 6).

Figure 7:
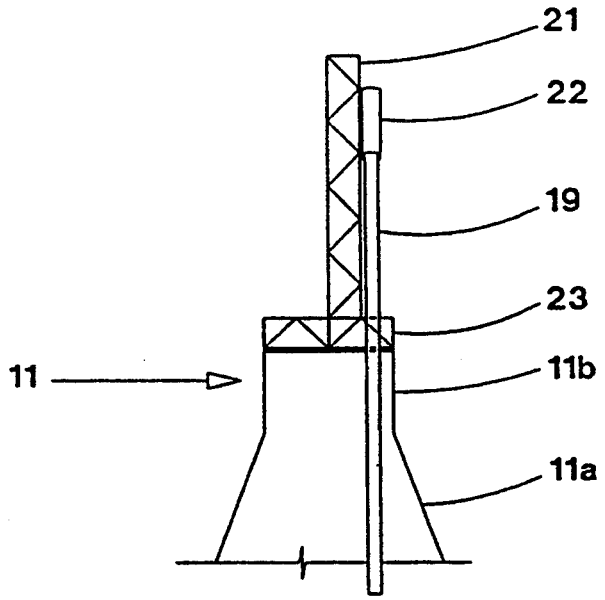
FIG. 7 is a partial view of the top of the leg showing a piling option.

Piling operations for the structure described can be carried out without the need for very large crane vessels. (Heavy offshore craneage is expensive and may not be readily available at a remote location.) As shown in FIG. 7, the deck support piles 19 can be pre-installed in the leg portions 11*a* and 11*b*. A piling frame 21, together with a hammer 22, can be pre-installed on a temporary work deck 23 on top of the leg portion 11*b*. The piles 19 can be driven into the seabed 14 using the hammer 22. (Peripheral piles 20, if required, can be driven using a relatively lightweight shear leg crane vessel).

Figure 8:
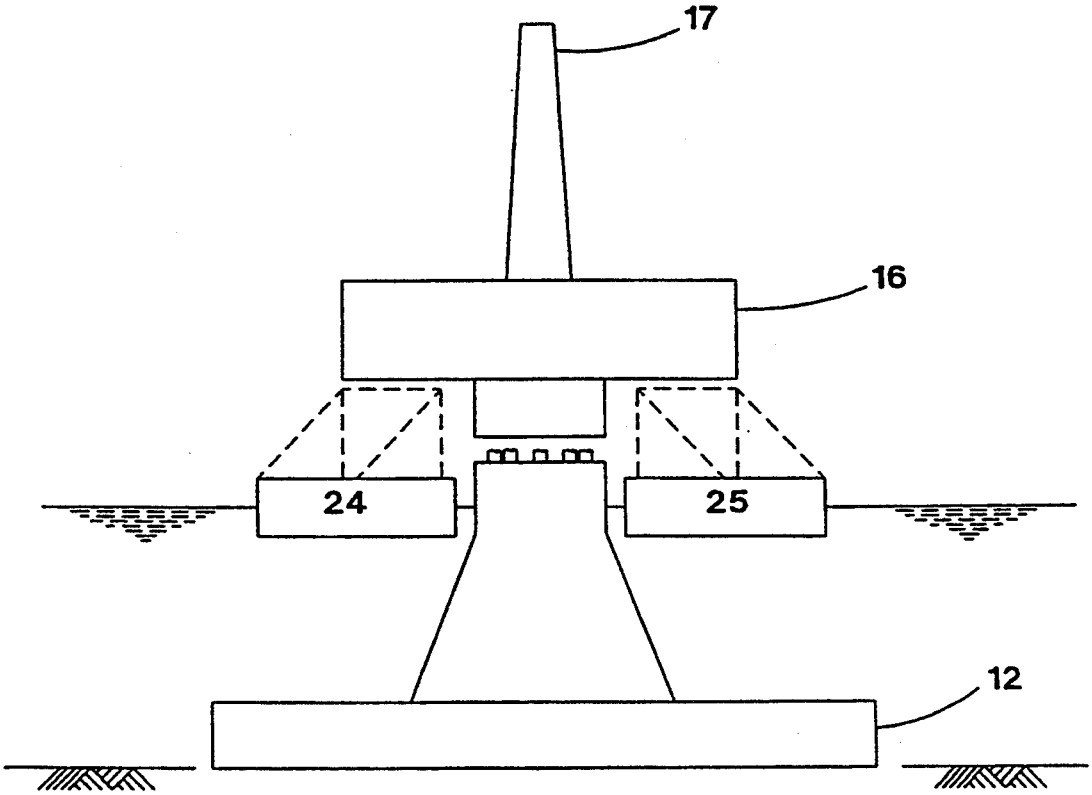
FIG. 8 is a diagrammatic view of a deck being installed to form an upper part of the structure.
Figure 3:
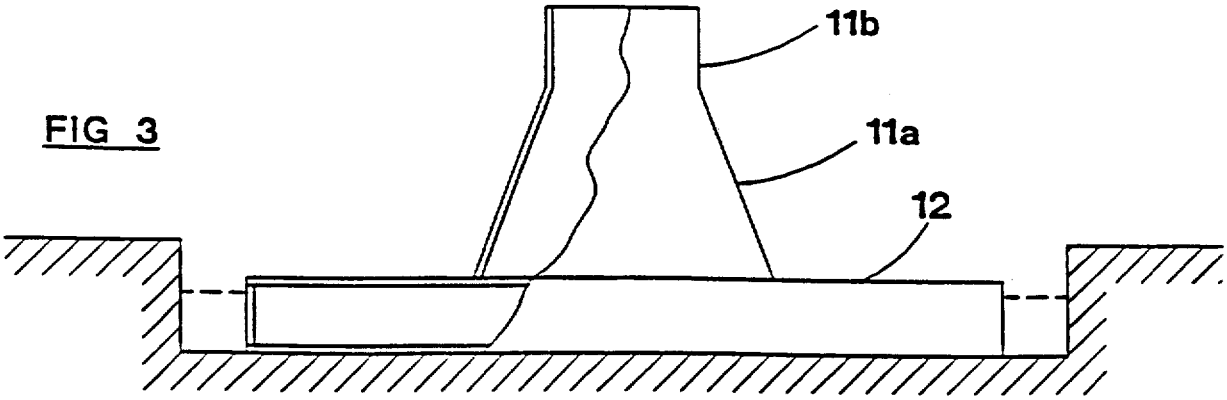
Figure 4:
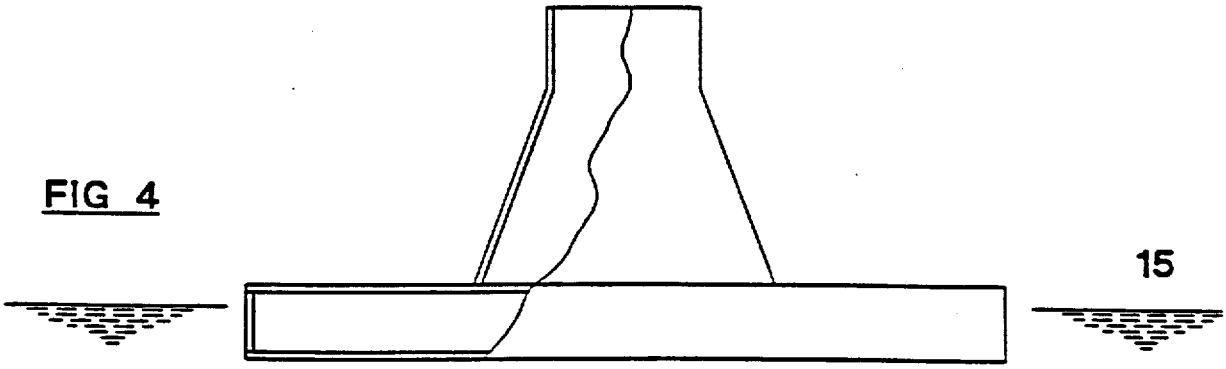

After the piles 19 have been driven, installation of the leg portion 11*c* and deck 16 can be achieved using the well known barge placement technique. For the monocone structure illustrated in FIG. 8 this involves a double barge arrangement (24, 25) straddling the leg 11 with the deck 16 topsides installed by deballasting. This installation technique obviates the need for heavy offshore craneage. Two further advantages are that deck/topsides construction is originally at ground level, and there is flexibility provided by the option of constructing the substructure and the deck/topsides in separate yards.

After deck installation, drilling for oil and gas can take place using the derrick 17, working through the interior of the leg 11.

The present figures illustrate a hybrid piled/gravity structure having a leg formed as a simple conical/cylindrical tower. Multi-leg designs incorporating similar features are also feasible.

I claim:

1. A method for installing a structure that stands offshore, the structure including a shield portion comprising a flat base having a first plan area, and a hollow leg having a second plan area smaller than said first plan area upstanding from a center of the base, the leg having a lower frustro conical part tapering upwardly from the base to an upper cylindrical part, in which the base rests on a seabed and is designed to resist lateral environmental loads primarily by friction forces generated by the weight of the shield bearing directly on the seabed, and in which said friction forces are supplemented by peripheral members on the base of the shield portion which project downwardly into the seabed to provide additional resistance to lateral environmental loads; and a separate support portion which comprises a group of free standing deck payload support piles to support vertical loads imposed by a deck payload, in which the group of piles is wholly surrounded by the shield portion, the method including the steps of:

moving the shield portion of the structure to its intended location;

setting the structure on the seabed;

driving the deck payload support piles individually and independently into the seabed;

driving the peripheral members downwardly into the seabed; and installing a permanent deck on top of the group of piles.

2. A structure for standing offshore and having a shield portion comprising a flat base having a first plan area, and a hollow leg having a second plan area smaller than said first plan area upstanding from a center of the base, the leg having a lower frustro conical part tapering upwardly from the base to an upper cylindrical part, in which the base rests on a seabed and is designed to resist lateral environmental loads primarily by friction forces generated by the weight of the shield bearing directly on the seabed, and in which said friction forces are supplemented by peripheral members on the base of the shield portion which project downwardly into the seabed to provide additional resistance to lateral environmental loads; and a separate support portion which comprises a group of free standing deck payload support piles which are driven individually and independently into the seabed to support vertical loads imposed by a deck payload, in which the group of piles is wholly surrounded by the shield portion, and in which there is a permanent deck installed on top of the group of piles.

3. A structure as claimed in claim 2 wherein the deck support piles are pre-installed in the shield portion of the structure and there is provision for a pile driving hammer to be supported temporarily on the structure for driving the pre-installed deck support piles into the seabed.

4. A structure as claimed in claim 2, wherein the shield portion is of double skin construction, and after installation at least a portion of the space between the skins is filled with grout.

* * * * *

UNITED STATES PATENT AND TRADEMARK OFFICE

CERTIFICATE OF CORRECTION

PATENT NO : 5,383,748

DATED : January 24, 1995

INVENTOR(S) : John W. Waddell

Figure 3:
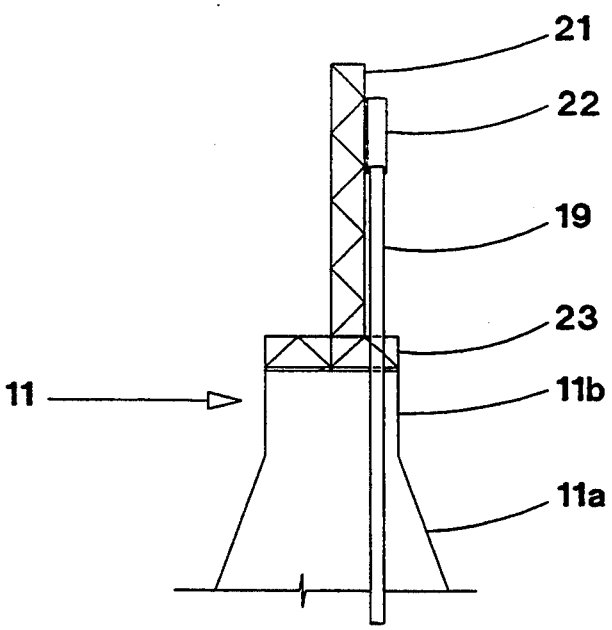
FIGS. 3–6 show successive stages in the construction, tow, ballasting and grouting of a lower part of the structure shown in FIG. 1.

It is certified that error appears in the above-identified patent and that said Letters Patent is hereby corrected as shown below:

The sheet of drawings consisting of Figs 3 and 4 should be replaced with the sheet of drawings, consisting of Figs. 3 and 4, as shown on the attached page.

Signed and Sealed this

Eighteenth Day of April, 1995

Bruce Lehman

*Attest:*

BRUCE LEHMAN

*Commissioner of Patents and Trademarks*

*Attesting Officer*